United States Patent [19]

Lindenmüller

[11] Patent Number: 4,504,259

[45] Date of Patent: Mar. 12, 1985

[54] FOLDING MACHINE

[75] Inventor: Johann Lindenmüller, Fürstenfeldbruck, Fed. Rep. of Germany

[73] Assignee: Autelca AG, Switzerland

[21] Appl. No.: 559,331

[22] Filed: Dec. 8, 1983

[30] Foreign Application Priority Data

Dec. 9, 1982 [CH] Switzerland ..... 7163/82

[51] Int. Cl.[3] ..... B31B 1/28

[52] U.S. Cl. ..... 493/23; 493/409; 493/446; 493/917

[58] Field of Search ..... 493/23, 917, 919, 922, 493/416, 417, 409, 421, 424, 446

[56] References Cited

U.S. PATENT DOCUMENTS

| | | | |
|---|---|---|---|
| 3,790,157 | 2/1974 | Crawford et al. | 493/23 |
| 3,905,593 | 9/1975 | Behn | 493/23 |
| 3,921,506 | 11/1975 | Holles | 493/23 |
| 3,961,781 | 6/1976 | Funk | 493/23 |
| 4,060,227 | 11/1977 | Landgrof | 493/23 |

*Primary Examiner*—Leon Gilden

*Attorney, Agent, or Firm*—Brady, O'Boyle & Gates

[57] ABSTRACT

The linear conveying route of a first folding material conveying device (1), oriented toward the roll nip (6) of a pair of folding rolls (7, 8), and the conveying route of a second folding material conveying device (11), the conveying direction (16, 17) of which is reversible, converge in an acute angle toward the folding roll nip (6). A deflection guide means guides, in its operative position (20), the portion (43) of the folding material (43, 44) leading in the conveying direction (9) of the first conveying device (1) from the conveying route end of this conveying device (1) to the conveying route of the second conveying device (11), whereupon both conveying devices (1 and 11) each continue transporting a portion of the folding material (43, 44) until the location (A) to be folded reaches a certain position at the deflection guide means (20). Thereupon, in a rest position (20') of the deflection guide means wherein the latter vacates the space between the pair of folding rolls (7, 8) and the conveying routes, the folding material (43, 44) is fed, with the site previously bent at the deflection guide means (20) in the leading position, to the pair of folding rolls (7, 8), by maintaining the conveying direction (9) of the first conveying device (1) and by driving the second conveying device (11) in the direction (17) in opposition to its previous conveying direction (16).

3 Claims, 12 Drawing Figures

FOLDING MACHINE

The invention relates to a folding machine, especially for folding one or several superimposed sheets of paper, for example for mail processing in envelope-stuffing machines.

BACKGROUND OF THE INVENTION

These machines are used for producing various folds for formats of differing sizes (simple fold, Z-fold, roll-type fold). For this purpose, the turning direction during folding is to be reversible; even a small section of the material to be folded must be reliably held in the machine during the folding step; and the side lengths of the folded products must be freely selectable within a large range and must be simply adjustable without cumbersome mechanical alteration, solely by the regulation of the machine. In particular, folding material with inflexible components, for example staples or credit cards or samples, must be foldable without disturbances (outside of these components).

In a conventional folding machine meeting these requirements, the folding material is introduced into a flat cassette up to the location of the fold to be formed, and the cassette is turned about an axis at right angles to the feeding direction. During this step, a contact roll presses this location of the material temporarily against the rim of the cassette at which it was introduced, and thereby folds the material at this location over this rim. Subsequently, the thus-folded material is taken over, with the apex of the fold leading, by a pair of folding rollers (European Patent Application 0 059 357 A 1). The turning direction during folding is reversible by reversing the direction of rotation of the cassette; the location of the folding material to be folded can be selected by the feeding distance of the material; and the portion of the material received by the cassette can contain inflexible components without any interference in the folding procedure.

The cassette of this conventional folding machine must be equipped with transport rolls driven in one direction for receiving the folding material, being at a stand-still during rotation of the cassette, and having to be driven after the rotation in the opposite direction, in order to convey the folding material to the pair of folding rolls. This requires an expensive gear system. The drive mechanism which rotates the cassette must work very accurately so that the cassette is in alignment with the feeding direction of the folding material for the introduction of the latter and, while passing the folded material on to the pair of folding rolls, is in alignment with the plane of the folding roll nip, for this is a prerequisite for a continued conveyance of the portion of the folding material, remaining temporarily in the cassette, within its plane so that it may contain inflexible components.

SUMMARY OF THE INVENTION

The patent invention solves the problem of providing a substantially simpler folding machine meeting the requirements described above, initially without reversing ability for the turning direction during folding. The further development according to the invention also makes it possible to reverse the turning direction during folding by altering the control. A further feature of the invention relates to a suitable embodiment of the deflection guide or guides and of the pair of folding rolls of the machine.

The advantages attainable by the invention are to be seen essentially in that it is unnecessary to drive any position-changing conveying rolls or other parts, to move any elements of appreciable mass, and to execute any accurate turning motions. It is merely necessary to drive all conveying rolls and folding rolls at the same peripheral speed. In total, the folding machine is thus distinguished by a simple, lightweight, inexpensive construction.

BRIEF DESCRIPTION OF THE DRAWINGS

The invention will be described in greater detail below with reference to drawings showing merely one embodiment in simplified, schematic views. In the drawings.

DESCRIPTION OF THE PREFERRED EMBODIMENT

Figure 1:
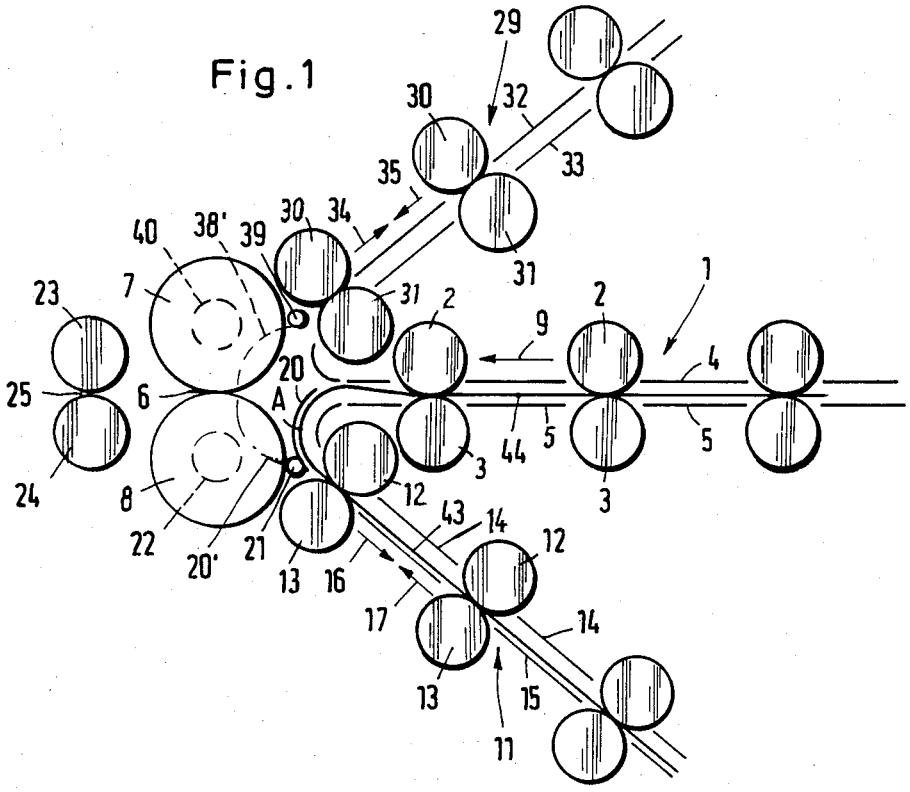
FIG. 1 is a schematic lateral view of a folding station of the invention.
Figure 2:
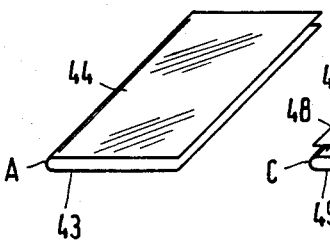
FIGS. 2, 3, and 4 are perspective views which respectively show a simple fold, a Z-fold, and a roll-type fold for sheet material.
Figure 3:
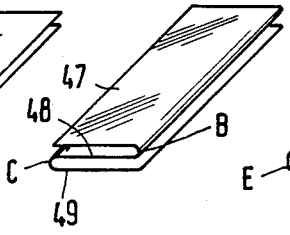
Figure 4:
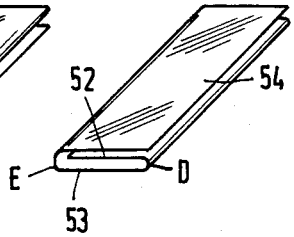

The folding station illustrated in FIG. 1 can be the only folding station of a machine for producing simple folds (FIG. 2), or the first or second station of a machine for producing Z-folds (FIG. 3) or roll-type folds (FIG. 4). In this connection, construction is identical apart from the fact that the thickness of the folding material may have to be considered which, when producing a second fold, is larger by one-half than when producing a first fold. The only difference resides in the respective conveying routes dependent on the format of the folding material and on the type of fold, and the turning directions dependent on the type of fold.

According to FIG. 1, the linear conveying path of a first folding material conveying device 1 with conveying rolls 2 and 3 and guide walls 4 and 5 is oriented toward the roll nip 6 of a pair of preliminary folding rolls 7, 8. Accordingly, the conveying route of this first conveying device 1 lies in the common tangential plane of the preliminary folding rolls 7 and 8. The first conveying device 1 effects conveyance in the direction 9.

The conveying route of a second folding material conveying device 11, comprising conveying rolls 12 and 13 and guide walls 14 and 15, extends at an acute angle with respect to the conveying route of the first conveying device 1, so that these two conveying routes converge toward the roll nip 6. The conveying direction of the second conveying device 11 is reversible (conveying directions 16 and 17).

A deflection guide means 20 associated with the two conveying routes is arranged in an apical zone of the acute angle up to which extend the conveying devices 1 and 11 and/or the conveying routes. This deflection guide means can be moved about an axle 21 into the operative position shown in solid lines, wherein it guides the folding material from the end of the conveying route of the first conveying device 1 to the conveying route of the second conveying device 11, and into an ineffective rest position 20', shown in dot-dash lines, wherein it vacates the space between the pair of preliminary folding rolls 7, 8 and the conveying routes of the conveying devices 1 and 11, i.e. the aforementioned apical zone. In order to make this space, wherein the folding material is not guided in the rest position 20' of the deflection guide means (FIG. 8), of a small dimension, and yet to make it possible for the deflection guide means to be swung out of this space, the deflection guide means consists, in the illustrated embodiment, of several guide brackets, and the folding roll 8 has peripheral grooves into which extends respectively one of the brackets when the deflection guide means is in the rest position 20' shown in dot-dash lines. The inner limitation of these grooves is denoted by 22. Since, due to these peripheral grooves, no continuously sharp fold is formed by the pair of folding rolls 7 and 8, these rolls act as a pair of preliminary folding rolls, and a finishing folding roll pair 23, 24 is provided, its roll nip 25, just as the roll nip 6 of the preliminary folding roll pair 7 and 8, lying in the conveying route plane of the first conveying device 1.

The conveying route of a third folding material conveying device 29, comprising conveying rolls 30 and 31 and guide walls 32 and 33, corresponding to the second folding material conveying device 11, is arranged, based on the conveying route of the first folding material conveying device 1, symmetrically to the route of the second folding material conveying device 11. The conveying directions of the third conveying device 29 are denoted by 34 and 35. In correspondence with the deflection guide means 20 associated with the first and second conveying devices 1 and 11, a second deflection guide means 38 is associated with the first and third conveying devices 1 and 29; this deflection guide means is swingable about an axle 39 and is shown only in its rest position 38' in FIG. 1 wherein its brackets project into peripheral grooves of the preliminary folding roll 7, the inner limitation of these grooves being denoted by 40.

If the folding material is to be turned for folding in the downward direction, only the first and second conveying devices 1 and 11 and the deflection guide means 20 associated therewith are being utilized. For upward turning, the first and third conveying devices 1 and 29 and the deflection guide 38 associated therewith are employed. The second or third conveying device 11 or 29, respectively, and the deflection guide means 20 or 38, respectively, is thus superfluous if turning is to be executed always in the same direction (upwardly or downwardly, respectively).

Figure 5:
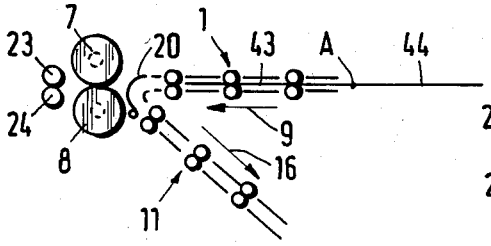
FIGS. 5 through 8 show processes before and during the folding of a simple fold with the folding machine of the invention.
Figure 6:
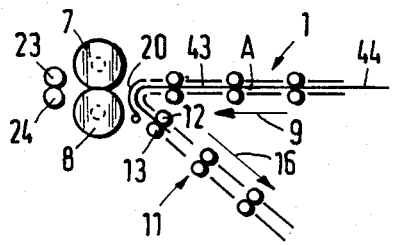
Figure 7:
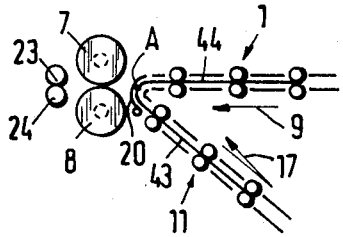
Figure 8:
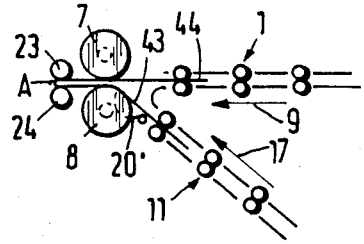

For the production of a single fold (FIG. 2), the folding material 43, 44, consisting of one or several superimposed sheets is fed to the first conveying device 1 (FIG. 5). If the portion 43 of the folding material leading in the conveying direction 9 is to be turned downwardly for folding, the deflection guide means 20 is initially in its operative position; the deflection guide means 38, if present, is in its rest position 38' (FIG. 1). The deflection guide means 20 guides the forward portion 43 of the folding material into the second conveying device 11; the conveying rolls 12 and 13 of the latter seize this portion and convey same in direction 16 (FIG. 6). Once the site A to be folded has reached a certain position on the deflection guide means 20 (FIG. 7), the deflection guide means 20 is swung into its rest position 20', and the previous conveying direction 16 of the second conveying device 11 is reversed (direction 17, FIG. 8). The direction reversal is illustrated in FIG. 7 (just as in FIG. 11 and correspondingly in FIG. 9) by a broken arrow, the tip of which points into the new direction. To reverse the conveying direction, the conveying device 1 can be conventionally equipped, for example, with a light barrier (not shown) adjustable along its conveying route, this light barrier responding to the end of the folding material portion 44 located at the rear in the conveying direction 9 and thus triggering reversal of the conveying direction. After a test folding step, the position of the light barrier is to be corrected, if necessary, in accordance with the spacing of the test fold from the desired folding site. The two conveying devices 1 and 11 then convey the folding material 43, 44 with the site bent by deflection in the leading position, namely the folding material portion 44 in direction 9 and the folding material portion 43 in direction 17, whereupon a fold is then formed at location A which, as mentioned above, is not continuous at first; thereafter, this fold is completed in the finishing folding roll pair 23 and 24 (FIG. 8). During these processes, the unturned part 44 of the folding material remains planar at all times during its passing through the entire folding station, i.e. this part can contain inflexible components, for example paper clips or a credit card, without there being any damage to same or without interference with the folding procedure.

Figure 11:
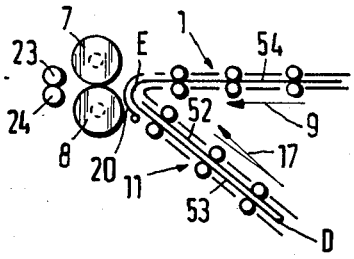
FIGS. 11 and 12 show processes while folding the second fold of a roll-type fold with the folding machine of the invention.

The processes for providing the first fold B or D of a Z-fold or a roll-type fold (FIGS. 3 and 4, respectively) are those described in conjunction with FIGS. 1, 2, and 5–8 for folding at location A, with the difference that the folding material is not folded, as is the norm with a single fold, in the center (A) but rather is folded between the first and second thirds 47 and 48 (FIGS. 3 and 9) or 52 and 53 (FIGS. 4 and 11).

Figure 9:
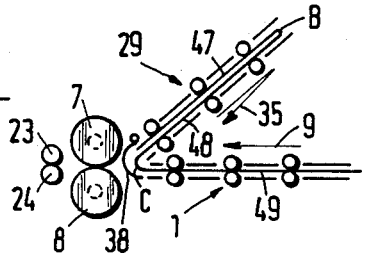
FIGS. 9 and 10 show processes during folding of the second fold of a Z-fold with the folding machine of the invention.
Figure 10:
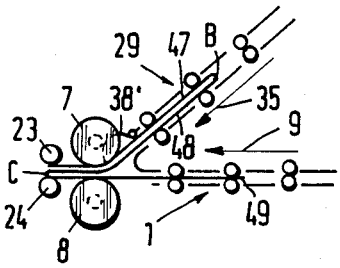

In order to fold the material 47, 48, 49, folded at B in a first folding station, once again at C to form a Z-fold (FIG. 3), the material is taken over, in the same direction and in the same plane in which it leaves the first folding station, by the conveying device 1 of a second folding station in direction 9, then deflected into the conveying device 29 along its deflection guide means 38 which is in the operative position, then conveyed in the conveying devices 1 and 29 in directions 9 and 34, until the site C has the predetermined position at the deflection guide means 38 (FIG. 9). Thereafter, with the deflection guide means having been swung into the rest position 38', the conveying device 1 is further driven in direction 9 and the conveying device 29 is driven in the reverse conveying direction 35. Thereby the material is transported, with the location previously curved along the deflection guide means 38 in the leading position, through the space presently vacated by the deflection guide means 38' in the rest position, to the preliminary folding roll pair 7, 8, preformed by folding at location C by this roll pair, and then subjected to a finishing folding step by the pair of finishing folding rolls 23, 24 (FIG. 10).

Figure 12:
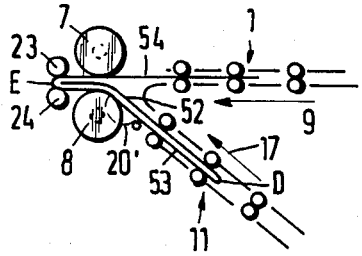

In order to fold the material, folded in a first folding station at D, once again for forming a roll-type fold (FIG. 4) at E, the material is taken over, in the same direction and in the same plane in which it leaves the first folding station, by the conveying device 1 of a second folding station in direction 9, deflected into the conveying device 11 in the operative position of its deflection guide means 20, conveyed in conveying devices 1 and 11 in directions 9 and 16, respectively, until location E has the predetermined position at the deflection guide means 20 (FIG. 11). Then, with the deflection guide means having been swung into the rest position 20', the conveying device 1 is further driven in direction 9 and the conveying device 11 is driven with reversed conveying direction 17 so that the material, with the site previously bent along the deflection guide means 20 in the leading position, is conveyed through the space presently vacated by the deflection guide means in the rest position 20' in between the preliminary folding rolls 7 and 8, preliminarily folded at site E, and thereafter subjected to a finishing folding step by the pair of finishing folding rolls 23, 24 (FIG. 12).

As can be seen, even during the production of a Z- or roll-type fold, the portion 49 or 54 of the folding material always remains planar and is always in the same plane, so that it can include, as mentioned above, inflexible components, such as, for example, paper clips or a credit card.

I claim:

1. Folding machine, characterized in that a first folding material conveying device (1) with a straight conveying route, oriented toward the roll nip (6) of a pair of folding rolls (7, 8), and a second folding material conveying device (11) of identical conveying speed, but with reversible conveying direction (16, 17) are arranged to be convergent at an acute angle toward the folding roll nip (6); that a deflection guide means (20) is associated with the two folding material conveying devices (1, 11) which is arranged in the apical zone of the acute angle and is movable into an operative position wherein it deflects the material from the end of the conveying route of the first conveying device (1) to the conveying route of the second conveying device (11), and into an ineffective rest position (20') wherein it vacates the space between the pair of folding rolls (7, 8) and the conveying routes; and that the drive mechanism for the conveying devices (1, 11) and for a moving means for the deflection guide means (20) is controlled so that, in the operative position of the deflection guide means (20), the material (43, 44) is conveyed in the first (1) and into the second conveying device (11) until the location (A) of the material (43, 44) to be folded has reached a predetermined point of the deflection guide means (20), then the deflection guide means (20) is moved into its rest position (20') and the first conveying device (1) is driven in its conveying direction (9) and simultaneously the second conveying device (11) is driven in the direction (17) in opposition to its previous conveying direction (16), in order to feed the material (43, 44), with the location (A) previously bent at the deflection guide means (20) in the leading position, to the folding roll nip (6).

2. Machine according to claim 1, characterized in that a third conveying device (29) corresponding to the second conveying device (11) is arranged preferably with its conveying route symmetrically to the conveying route of the second conveying device (11) with reference to the conveying route of the first conveying device (1); that a second deflection guide means (38) corresponding to the deflection guide means (20) is associated with the first (1) and third conveying device (29); and that selectively the third conveying device (29) is drivable and/or movable in place of the second conveying device (11), and the second deflection guide means (38) is drivable and/or movable in place of the first deflection guide means (20).

3. Machine according to claim 1, in which the deflection guide means, or each deflection guide means (20, 38), respectively, is constituted by several guide brackets pivotable in unison, these brackets, in the rest position of the deflection guide means, each projecting into a peripheral groove (22, 40) of one of the folding rolls (7, 8), which latter form a pair of preliminary folding rolls, followed by a pair of finishing folding rolls (23, 24), the rolls of the latter exhibiting an uninterrupted outer surface; and that the roll nip (6) of the pair of preliminary folding rolls (7, 8) and the roll nip (25) of the pair of finishing folding rolls (23, 24) lie in the plane of the conveying route of the first conveying device (1).

* * * * *